US009336965B2

(12) United States Patent
Yano et al.

(10) Patent No.: US 9,336,965 B2
(45) Date of Patent: May 10, 2016

(54) SEALED CONTACT DEVICE

(71) Applicant: OMRON CORPORATION, Kyoto-shi, Kyoto (JP)

(72) Inventors: Keisuke Yano, Kikuchi (JP); Yasuo Hayashida, Kumamoto (JP); Ryuichi Hashimoto, Yamaga (JP); Shingo Mori, Yamaga (JP); Takuma Okamoto, Kikuchi (JP)

(73) Assignee: OMRON Corporation, Kyoto (JP)

( * ) Notice: Subject to any disclaimer, the term of this patent is extended or adjusted under 35 U.S.C. 154(b) by 473 days.

(21) Appl. No.: 13/767,848

(22) Filed: Feb. 14, 2013

(65) Prior Publication Data

US 2013/0240495 A1 Sep. 19, 2013

(30) Foreign Application Priority Data

Mar. 15, 2012 (JP) ..... 2012-059296

(51) Int. Cl.

| | |
|---|---|
| ***H01H 9/36*** | (2006.01) |
| ***H01H 9/44*** | (2006.01) |
| *H01H 50/20* | (2006.01) |
| *H01H 51/29* | (2006.01) |

(52) U.S. Cl.

CPC ..... *H01H 9/36* (2013.01); *H01H 9/443* (2013.01); *H01H 50/20* (2013.01); *H01H 51/29* (2013.01)

(58) Field of Classification Search

CPC ..... H01H 9/443; H01H 9/36; H01H 51/29; H01H 50/20; B23K 9/32

See application file for complete search history.

(56) References Cited

U.S. PATENT DOCUMENTS

| | | | | |
|---|---|---|---|---|
| 5,416,455 | A | 5/1995 | Moldovan | |
| 6,700,466 | B1 * | 3/2004 | Yamamoto et al. | 335/132 |
| 7,812,276 | B2 * | 10/2010 | Maloney et al. | 218/148 |
| 7,915,985 | B2 * | 3/2011 | Schmitz et al. | 335/201 |

FOREIGN PATENT DOCUMENTS

| | | | |
|---|---|---|---|
| EP | 0892415 | | 1/1999 |
| JP | S55-029045 | U | 2/1980 |
| JP | 2002-110020 | A | 4/2002 |
| JP | 2003-197053 | | 7/2003 |
| JP | 2005-285547 | A | 10/2005 |
| KR | 10-0525878 | | 12/2005 |
| WO | WO 01/27950 | | 4/2001 |

(Continued)

OTHER PUBLICATIONS

Notice of Reasons for Rejection (in Japanese with an English-language translation) issued Dec. 1, 2015, by the Japanese Patent Office for corresponding Japanese Patent Application No. 2012-059296.

*Primary Examiner* — Mohamad Musleh

(74) *Attorney, Agent, or Firm* — Klarquist Sparkman, LLP

(57) ABSTRACT

The invention provides a sealed contact device capable of extinguishing an arc which extends in an arbitrary direction. The sealed contact device includes a housing; a fixed contact and a movable contact disposed in the housing in such a manner as to face each other; and permanent magnets which are disposed with the fixed contact and the movable contact interposed therebetween and which attracts an arc between the fixed contact and the movable contact using a magnetic force. An arc shielding member is disposed at a position to which the arc is attracted by current flowing between the fixed contact and the movable contact and by the magnetic force between the permanent magnets, in the housing.

9 Claims, 12 Drawing Sheets

(56) References Cited

FOREIGN PATENT DOCUMENTS

| | | | |
|---|---|---|---|
| WO | WO 2011/115049 | | 9/2011 |
| WO | WO 2011115049 | A1 * | 9/2011 |
| WO | WO 2011/147458 | | 12/2011 |
| WO | WO 2011147458 | A1 * | 12/2011 |

* cited by examiner

SEALED CONTACT DEVICE

BACKGROUND OF THE INVENTION

1. Technical Field

The present invention relates to a sealed contact device, and more particularly to an electromagnetic relay for power loads which can promptly extinguish an arc which occurs.

2. Related Art

In the related art, as an arc extinguisher used in a sealed contact device, for example, Japanese Unexamined Patent Publication No. 2005-285547 discloses a device which extinguishes an arc occurring between a movable contact piece and a fixed contact piece when a contact of the fixed contact piece is separated from a contact of the movable contact piece by narrowing the arc between right and left sidewalls of an arc barrier.

However, the above-mentioned arc extinguisher, as illustrated in FIG. 1 of the prior art, has had a problem that an arc can be extinguished when the arc between contacts reaches an arc barrier 5, but the arc cannot be promptly and certainly extinguished when the arc does not reach the arc barrier.

The present invention has been made in view of the above-mentioned problem of the related art, and an object of the present invention is to provide a sealed contact device which can attract an arc if and when it occurs to extinguish the arc promptly and certainly.

SUMMARY

In order to solve the above-mentioned problem, in accordance with one aspect of the invention, there is provided a sealed contact device including a housing, a fixed contact and a movable contact disposed in the housing in such a manner as to face each other, and permanent magnets which are disposed with the fixed contact and the movable contact interposed therebetween and which attracts an arc between the fixed contact and the movable contact using a magnetic force, wherein an arc shielding member is disposed at a position to which the arc is attracted by current flowing between the fixed contact and the movable contact and by the magnetic force of the permanent magnets, in the housing.

According to the present invention, even though the arc occurs in an arbitrary direction, the arc is attracted in a desired direction by the current and the magnetic force so that the arc may reach the arc shielding member, resulting in the arc being extinguished.

As an embodiment of the present invention, the arc shielding member may have at least one arc receiving piece. This configuration allows an increase in surface area of the arc shielding member. This also allows the arc to easily hit the arc shielding member, thereby increasing the performance of the mechanism utilized to extinguish the arc.

As another embodiment of the present invention, the arc shielding member may be disposed at both sides of the contacts and formed along opposed surfaces of the permanent magnets. The opposed surfaces are arranged so that the magnetic field flows from one magnet to another. This configuration enables the arc to hit the arc shielding member disposed on either one of the contacts so that the arc may be extinguished even though a direction of the arc changes.

As a further embodiment of the present invention, the arc shielding member may be formed to have an approximately cross-sectional U shape and may be disposed in the housing. By forming the arc shielding member to have the sectional U shape, the arc shielding member can be relatively easily gripped and the mounting workability of mounting the arc shielding member to a sealed space improves as compared with a plate-like arc shielding member.

A cross-sectional U-shaped base portion of the arc shielding member may be placed on the bottom in the housing. This configuration can secure a mountability of the arc shielding member to the housing, without interfering with movements of the fixed contact and the movable contact.

As a yet further embodiment of the present invention, the arc shielding member may be made of a metal. This configuration allows the arc which has hit the arc shielding member to be cooled, so that an ability of extinguishing the arc can be enhanced.

As a yet further embodiments of the present invention, the arc shielding member may include a plate-like connector and arms which are formed to perpendicularly bend from both ends of the connector, respectively, in which the at least any one of the connector and the arms may be provided with at least one arc receiving piece.

As a yet further embodiment of the present invention, the arc shielding member may have at least one arc receiving piece obtained by bending an edge portion of the connector.

As a yet further embodiment of the present invention, the at least one arc receiving piece may be provided by bending an edge portion of the arm, and an inside surface of the arm may be provided with a protrusion.

DETAILED DESCRIPTION

An embodiment in which a sealed contact device according to the present embodiment is applied to a sealed electromagnetic relay is described with reference to FIGS. 1 through 12 of the accompanying drawings.

Figure 1:
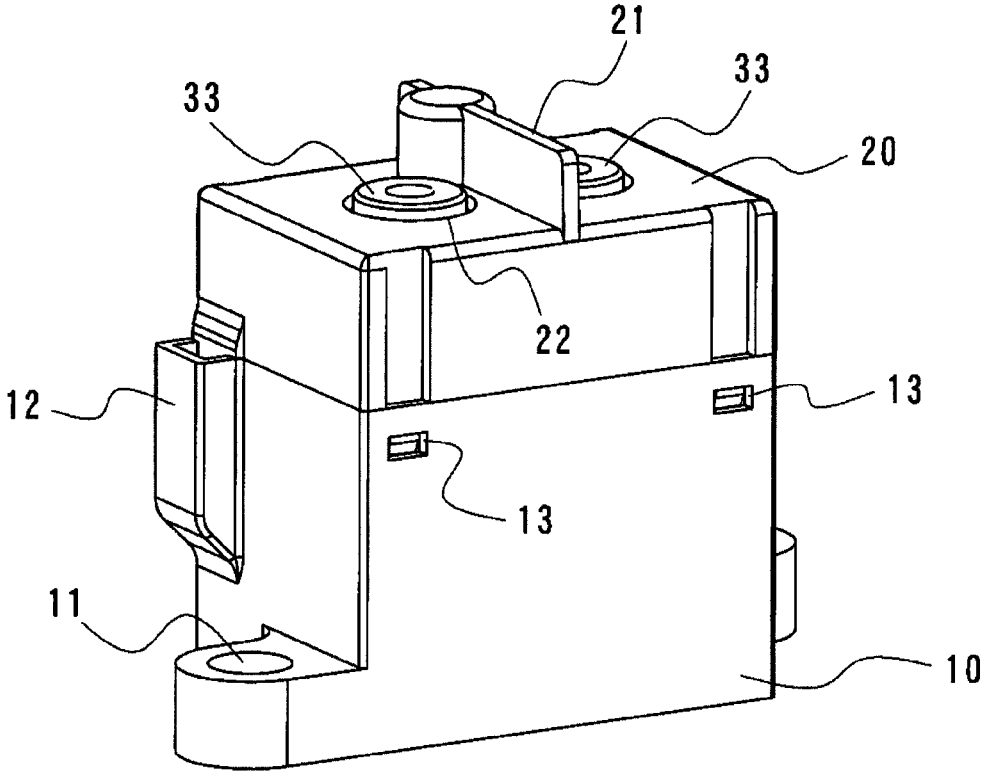
FIG. 1 is a whole perspective view illustrating an embodiment of a sealed contact device according to the present invention.
Figure 2:
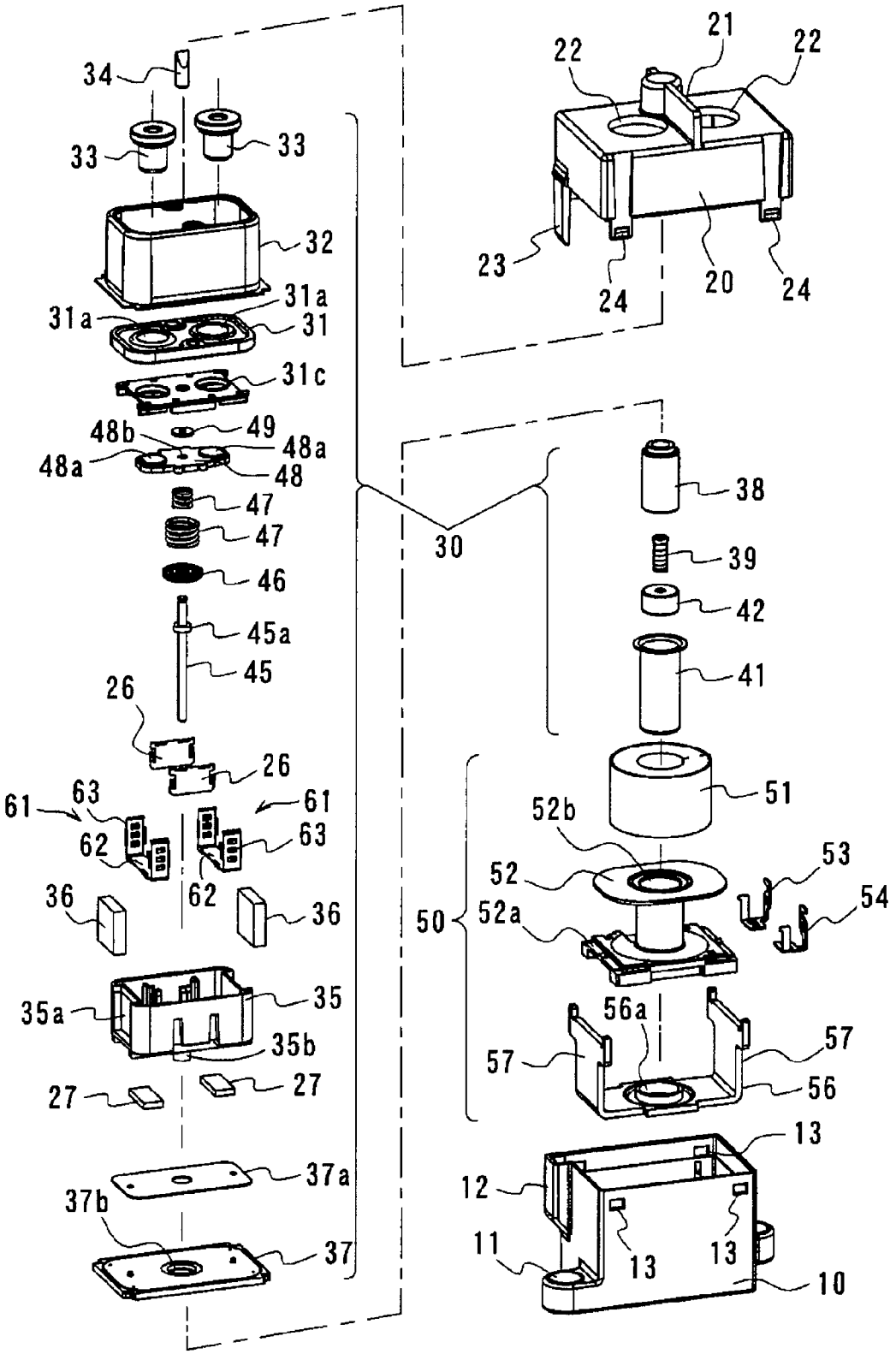
FIG. 2 is an exploded perspective view of the sealed contact device illustrated in FIG. 1.
Figure 3B:
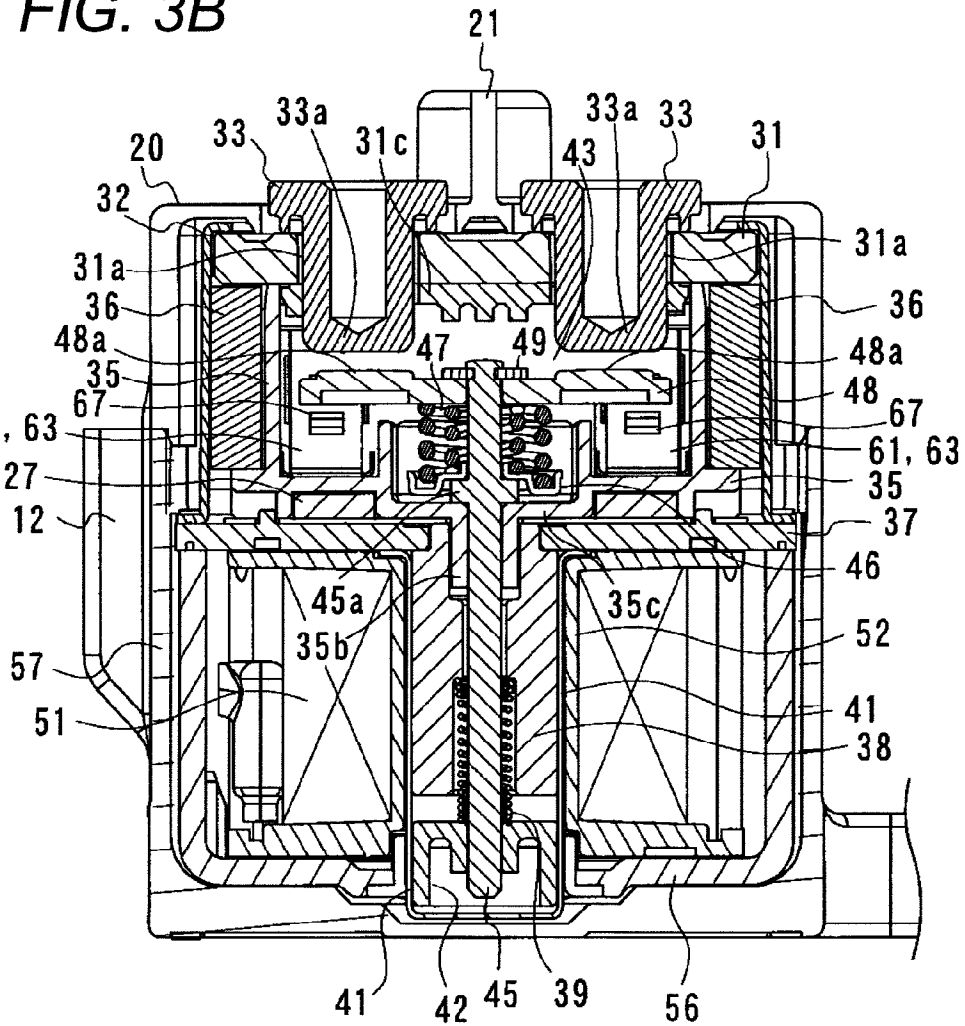
FIGS. 3A and 3B are a side sectional view and a front sectional view before the sealed contact device illustrated in FIG. 1 operates.
Figure 3A:
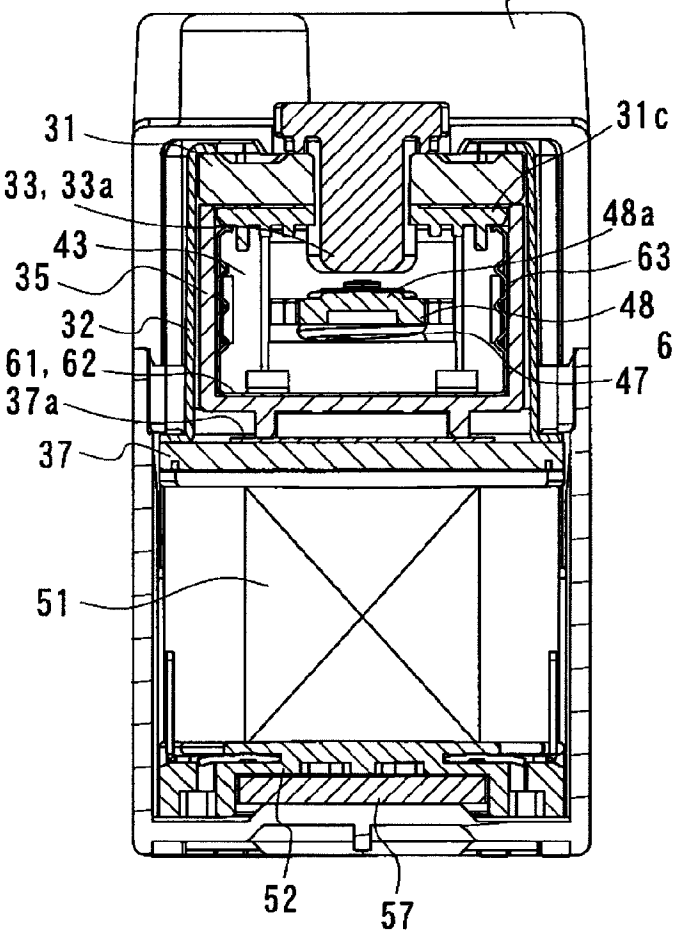

As illustrated in FIG. 2, the sealed electromagnetic relay according to the present embodiment is configured by disposing a contact mechanism part 30 and an electromagnet part 50 which drives the contact mechanism part 30 from the outside of a sealed space 43 shown in FIG. 3A in a housing which is formed by attaching a cover 20 to a case 10. The contact mechanism part 30 is incorporated in the sealed space 43 formed by a ceramic plate 31, a metallic cylindrical flange 32, a plate-like first yoke 37 and, and a closed end barrel 41.

The case 10 is an approximately box-shaped resin-molding article, and has a mounting hole 11 provided in a hornlike portion disposed in a lower corner of an outer surface. The case 10 further has a bulging portion 12 in the corner of a side surface for pulling out a lead (not shown in the drawing) and latching holes 13 in opposed side surfaces and at an edge portion of an opening.

The cover 20 has a plane shape which can cover an opening of the case 10, and is provided with terminal holes 22 and 22 at both sides of a partition wall 21 formed to protrude in the center of the upper surface thereof. The cover 20 is provided with a projection 23, on one side surface of one side thereof, which can prevent so-called flapping of the lead (not shown) by being inserted in the bulging portion 12 of the case 10. The cover 20 is provided with latching claws 24 at an edge portion of the opening and in the opposite side surface, and the latching claws 24 can be latched in the latching holes 13 of the case 10.

The contact mechanism part 30 is disposed in the sealed space 43 (refer to FIG. 3A) formed by the ceramic plate 31, the metallic cylindrical flange 32, the plate-like first yoke 37, and the closed end barrel 41 as described above. The contact mechanism part 30 includes a magnet holder 35, a fixed iron core 38, a movable iron core 42, a movable shaft 45, and a movable contact piece 48.

The ceramic plate 31 has a plane shape so that the ceramic plate 31 may be brazed to an edge portion of an upper opening of the metallic cylindrical flange 32 described below, is provided with a pair of terminal holes 31*a*, and is used in combination with an auxiliary plate 31*c*. The ceramic plate 31 has a metal layer (not shown) at each of an outer periphery portion of the upper surface thereof and opening edge portions of the terminal holes 31*a*. As illustrated in FIG. 3B, fixed contact terminals 33 which have fixed contacts 33*a* firmly attached to the bottoms, respectively are brazed to the edges of the terminal holes 31*a* of the ceramic plate 31.

The metallic cylindrical flange 32 brazed to the outer periphery portion of the upper surface of the ceramic plate 31 has an approximately cylindrical shape as illustrated in FIG. 2 and is formed by press-processing a metallic plate. An outer periphery portion of a lower portion of the metallic cylindrical flange 32 is integrally combined with the plate-like first yoke 37 by welding.

The magnet holder 35 accommodated in the metallic cylindrical flange 32 is formed of a heat-resistant insulating member having a box shape, and is provided with pocket grooves 35*a* which can retain the permanent magnets 36 therein, respectively and which are in both external side surfaces opposite to each other. The magnet holder 35 is provided with an annular cradle 35*c* (refer to FIG. 3B) in a lower deck in the center of the bottom surface, and a cylindrical insulating portion 35*b* which protrudes downward from the lower surface of the center of the annular cradle 35*c*. Even though an arc occurs and a voltage in a path between the metallic cylindrical flange 32, and the plate-like first yoke 37 and the fixed iron core 38 is increased to a high voltage, because the cylindrical insulating portion 35*b* electrically insulates the cylindrical fixed iron core 38 and the movable shaft 45 from each other, both of them can be prevented from being integrally welded. Positioning plates 26 disposed in such a manner as to face each other in the magnet holder 35 are disposed so as to be brought into contact with the movable contact piece 48, and positions the movable contact piece 48 by preventing rotation of the movable contact piece 48. A rubber plate 27 is disposed between the magnet holder 35 and the first yoke 37 to buffer the shock which arises between the magnet holder 35 and an annular jaw 45*a* when the fixed contact 33*a* and the movable contact 48*a* are separated from each other.

Figure 4A:
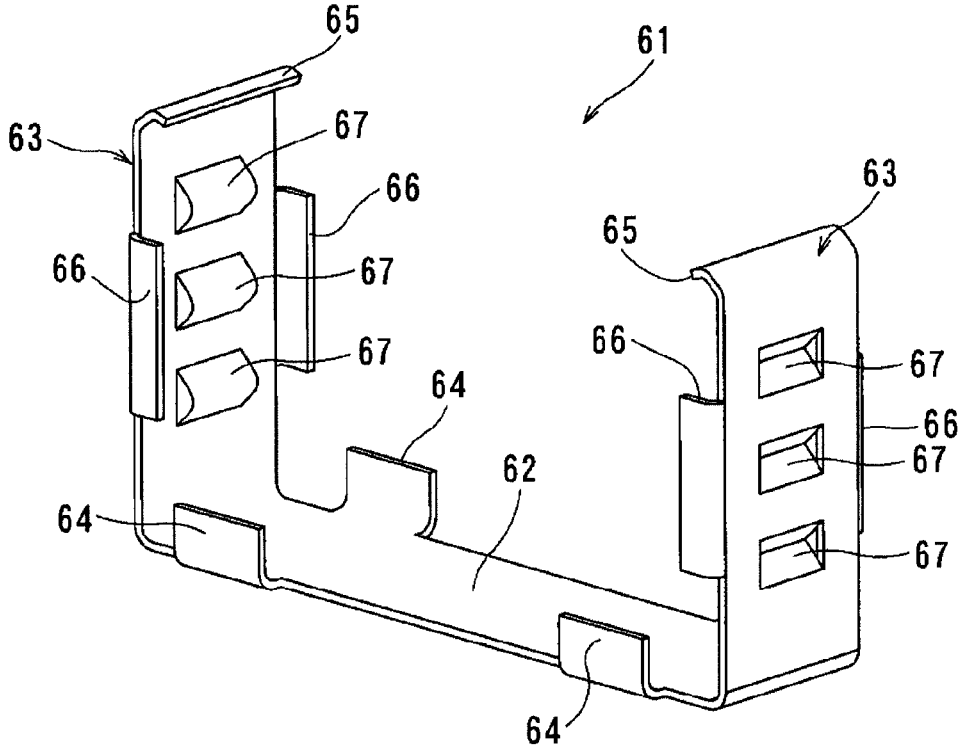
FIGS. 4A and 4B are a perspective view and a sectional view of an arc shielding member of a first embodiment according to the present invention.
Figure 4B:
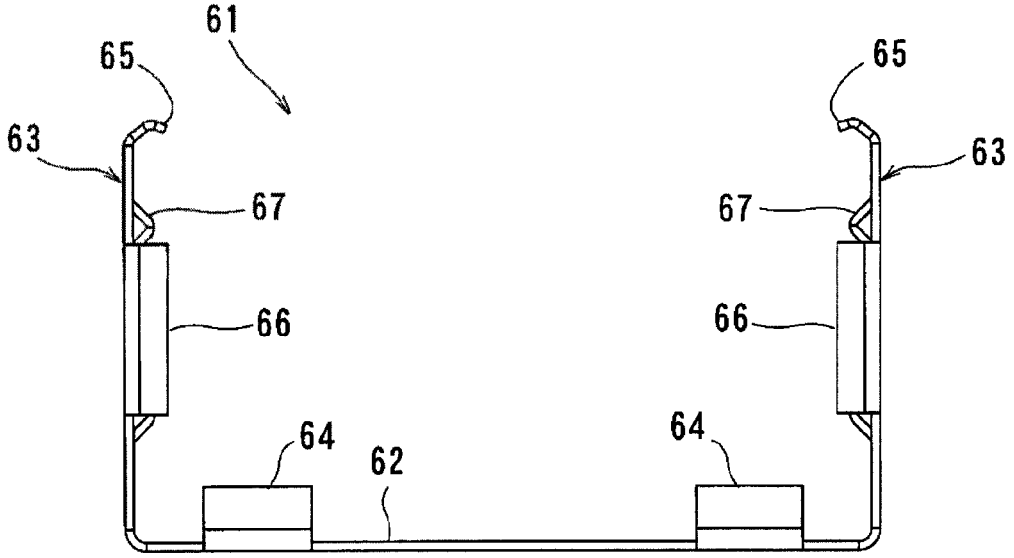

In addition, an arc shielding member 61 according to a first embodiment of the present invention is arranged inside of the magnet holder 35. The arc shielding member 61 is made of, for example, a metal such as Stainless steel, and has an approximately sectional U shape as illustrated in FIGS. 4A and 4B.

That is, the arc shielding member 61 includes a plate-like connector 62 and arms 63 formed by bending upward both ends of the connector 62. Opposed edge portions of the connector 62 are provided with tongue-shaped pieces (arc receiving pieces) 64, respectively which are bent upward to stand upright. Each of the arms 63 includes an upper rib (arc receiving piece) 65 which bends inward from an upper end, a pair of side edge ribs (arc receiving pieces) 66 which bends inward from opposed side edges, and draining board-like protrusions (arc receiving pieces) 67 which protrude inward from the inside surface.

In addition, in the arc shielding member 61, the connector 62 is placed on a bottom wall of the magnet holder 35, and the arms 63 are fixed to opposed side walls of the magnet holder 35.

As illustrated in FIG. 2, the plate-like first yoke 37 has a plane shape which may be fitted into the edge portion of the opening of the case 10, an elastic plate 37*a* fixed to an upper surface thereof, and a caulking hole 37*b* in the center thereof. An upper end of the cylindrical fixed iron core 38 is fixed to the caulking hole 37*b* of the plate-like first yoke 37 in a caulking manner, and the plate-like first yoke 37 is fitted into the lower opening of the metallic cylindrical flange 32 and is integrally combined with the metallic cylindrical flange 32 by welding performed from the outside.

The movable shaft 45 with an annular flange 45*a* is slidably inserted in a through-hole of the cylindrical fixed iron core 38 via the cylindrical insulating portion 35*b* of the magnet holder 35. The movable shaft 45 is fixed by inserting a release spring 39 and welding the movable iron core 42 to the bottom of the release spring 39.

As for the closed end barrel 41 in which the movable iron core 42 is accommodated, the edge portion of the opening is hermetically joined with a lower edge portion of the caulking hole 37*b* provided in the plate-like first yoke 37. Next, inside air is suctioned from a degassing pipe 34 so that the inside space is sealed to form a sealed space 43.

As illustrated in FIG. 3B, a dish-like receiving tool 46 is latched by the annular flange 45*a* provided in the middle portion of the movable shaft 45 so that the inserted contact spring 47 and the movable contact piece 48 may be prevented from falling apart, and a stopper ring 49 is fixed to an upper end portion of the movable shaft 45. The movable contacts 48*a* provided at both ends of the upper surface of the movable contact piece 48 are disposed to face with each other and to be able to move to and from the fixed contacts 33*a* of the contact terminal 33 disposed in the metallic cylindrical flange 32.

As illustrated in FIG. 2, in the electromagnet part 50, coil terminals 53 and 54 are press-fitted and fixed to a flange 52*a* of a spool 52 around which a coil 51 is wound, and the coil 51 and the lead (not shown) are connected to each other via the coil terminals 53 and 54. The closed end barrel 41 is inserted in the through-hole 52*b* of the spool 52 and is fitted into a fitting hole 56*a* of a second yoke 56. Subsequently, upper ends of both side portions 57 and 57 of the second yoke 56 engage with both end portions of the plate-like first yoke 37, respectively and then fixed to each other by a method such as caulking, press-fitting, and welding, so that the electromagnet part 50 and contact mechanism part 30 are integrally combined.

Next, operation of the sealed magnetic relay having the above-described structure will be described.

First, as illustrated in FIGS. 3A and 3B, when a voltage is not applied to the coil 51, the movable iron core 42 is biased to a lower side by the spring force of the release spring 39, the movable shaft 45 is pushed down, and the movable contact piece 48 is pulled down. At this time, although the annular flange 45*a* of the movable shaft 45 engages with the annular cradle 35*c* of the magnet holder 35 and the movable contact 48*a* is separated from the fixed contact 33*a*, the movable iron core 42 is not in contact with the bottom surface of the closed end barrel 41.

Subsequently, when a voltage is applied to the coil 51 so that the coil 51 is magnetized, the movable iron core 42 is attracted by the fixed iron core 38 and the movable shaft 45 will slide up against the spring force of the release spring 39. Even after the movable contact 48*a* is brought into contact with the fixed contact 33*a*, the movable shaft 45 is pushed up against the spring force of the release spring 39 and the contact spring 47, the upper end of the movable shaft 45 projects from a shaft hole 48*b* of the movable touch piece 48, and the movable iron core 42 is attracted and attached to the fixed iron core 38.

Next, when the application of the voltage to the coil 51 is stopped and the magnetization is resolved, the movable iron core 42 will separate from the fixed iron core 38 due to the spring force of the contact spring 47 and the release spring 39. For this reason, after the movable shaft 45 slides down to the lower side and the movable contact 48*a* separates from the fixed contact 33*a*, the annular flange 45*a* of the movable shaft 45 engages with the annular cradle 35*c* of the magnet holder 35, and thus returns to the original state.

At this time, an arc may occur between the fixed contact 33*a* of a high voltage and the movable contact 48*a*. In FIG. 3B, the arc is attracted and induced in a direction orthogonal to the orientation of arms 63 of arc shield member 61 by the current which flows between the fixed contact 33*a* and the movable contact 48*a*, and the magnetic force which is horizontally generated between the opposed permanent magnets 36. The arms 63 of the arc shielding member 61 are installed in the direction in which the arc is attracted. For this reason, even though the arc is generated in an arbitrary direction, the arc is first induced in a desired direction by the current which flows between the fixed contact 33*a* and the movable contact 48*a* and the magnetic force which is generated horizontally between the opposed permanent magnets 36, and is allowed to hit the arc shielding member 61, so that the arc is extinguished.

Especially, because the arc shielding member 61 has a plurality of protrusions 67, the surface area of the inside surface of the arc shielding member 61 is increased. Because of this, the arc can be promptly cooled, and thus the arc can be efficiently extinguished.

In addition, the arc shielding member 61 is formed to have an approximately sectional U shape, and the connector (base portion) 62 in the sealed space 43 (magnet holder 35) is placed on the bottom surface in the magnet holder 35. For this reason, compared with the case of using a simple plate-like arc shielding member, the arc shielding member 61 can be gripped easily so that a mounting workability to the sealed space 43 (magnet holder 35) may improve. In addition, the mountability of the arc shielding member 61 into the sealed space 43 can be secured without interfering with movements of the fixed contact 33*a* and the movable contact 48*a*.

The arms 63 of the arc shielding member 61 are disposed at both sides of the fixed contact 33*a* and the movable contact 48*a* and disposed along the opposed surfaces of the permanent magnets 36. For this reason, even though the directions of the current and/or the magnetic flux change and thus the direction in which an arc occurs changes, the arc can hit either one of the arms 63 and be extinguished.

In addition, because the arc shielding member 61 is made of a metal, the arc which hits the arc shielding member 61 can be efficiently cooled, and the capability of extinguishing the arc can be enhanced.

Other embodiments of the arc shielding member which can be used with the sealed contact device described herein are described below with reference to FIGS. 5A-B to 11A-B.

Second Embodiment

Figure 5A:
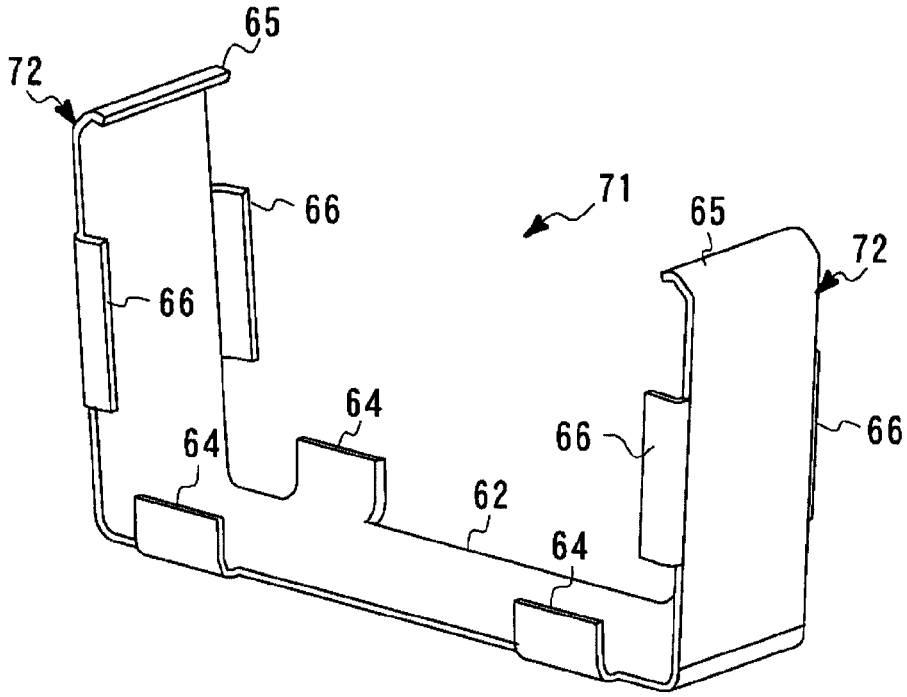
FIGS. 5A and 5B are a perspective view and a side elevation view of an arc shielding member of a second embodiment according to the present invention.
Figure 5B:
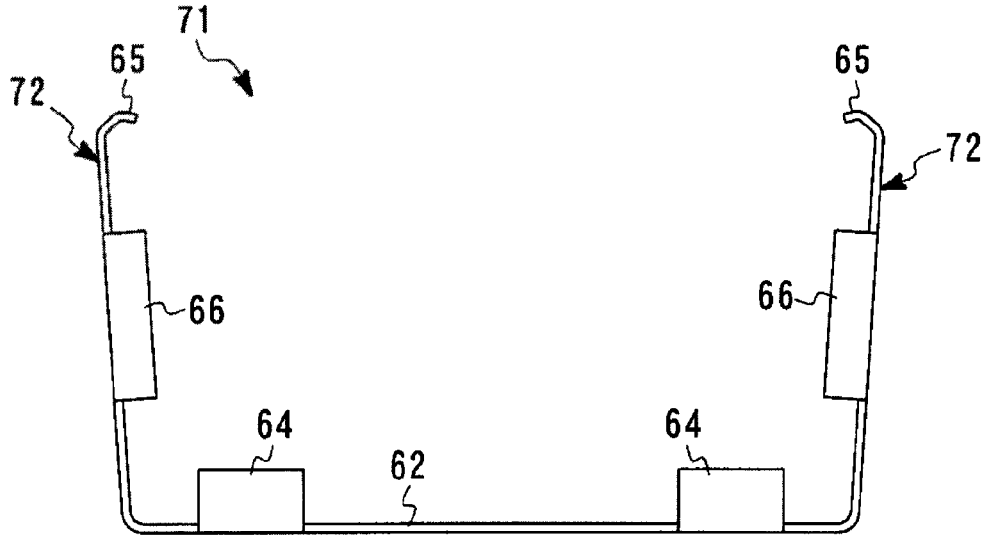

An arc shielding member 71 according to a second embodiment of the present invention is illustrated in FIGS. 5A and 5B.

Although the arms 63 of the arc shielding member 61 according to the first embodiment are provided with the protrusions 67, the configuration is not limited thereto. Arms 72 of a simple plate shape may be adopted like the arc shielding member 71 according to the second embodiment. With this configuration, it is possible to certainly prevent the arc from passing by the arms 72. Because other portion are the same as those of the first embodiment, like portions are denoted by like reference signs and detailed description thereof is not given.

Third Embodiment

Figure 6A:
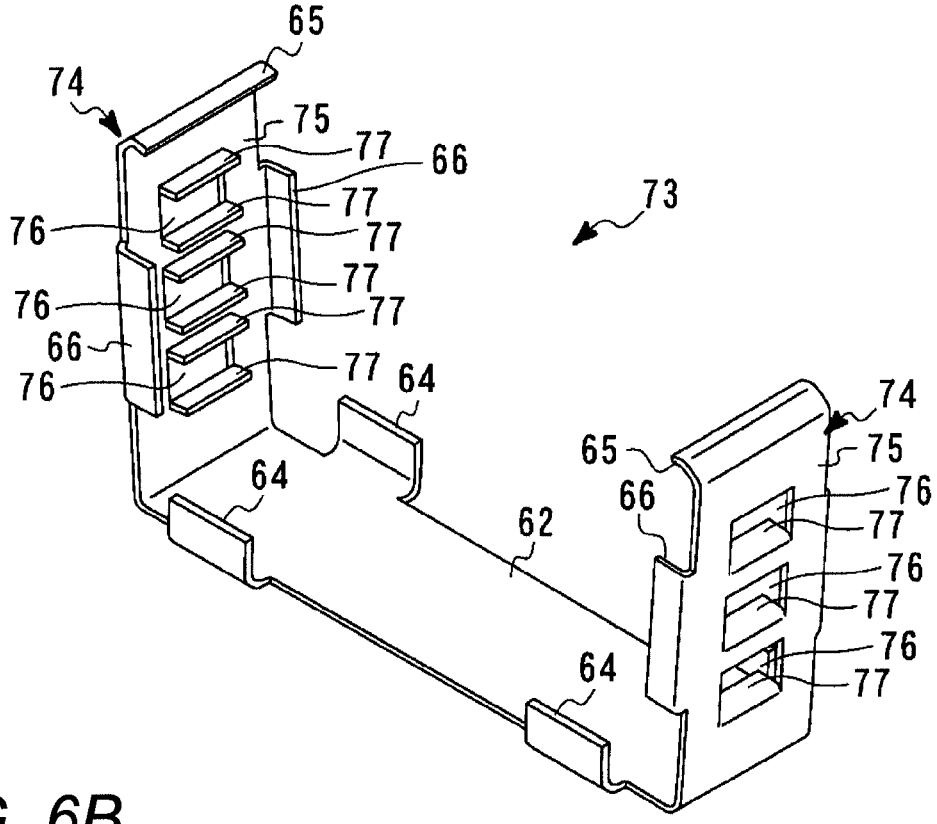
FIGS. 6A and 6B are a perspective view and a side elevation view of an arc shielding member of a third embodiment according to the present invention.
Figure 6B:
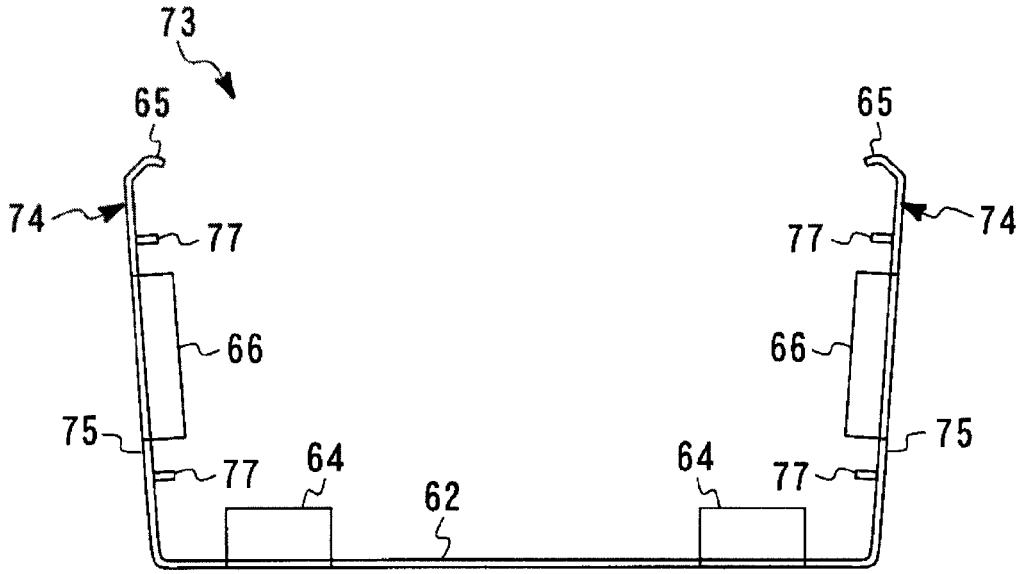

An arc shielding member 73 according to a third embodiment of the present invention is illustrated in FIGS. 6A and 6B.

Although the arms 63 of the arc shielding member 61 according to the first embodiment are provided with the protrusions 67, the configuration is not limited thereto. For example, like arms 74 of the arc shielding member 73 according to the third embodiment, protruding pieces (arc receiving pieces) 77 protruding inward from an upper edge and a lower edge of an opening 76 which are provided side by side in a folded plate 75 may be formed by cutting out. Thereby, the arc shielding member 73 with a high yield of material is obtained. Because other portion are the same as those of the first embodiment, like portions are denoted by like reference signs and detailed description thereof is not given.

Fourth Embodiment

Figure 7A:
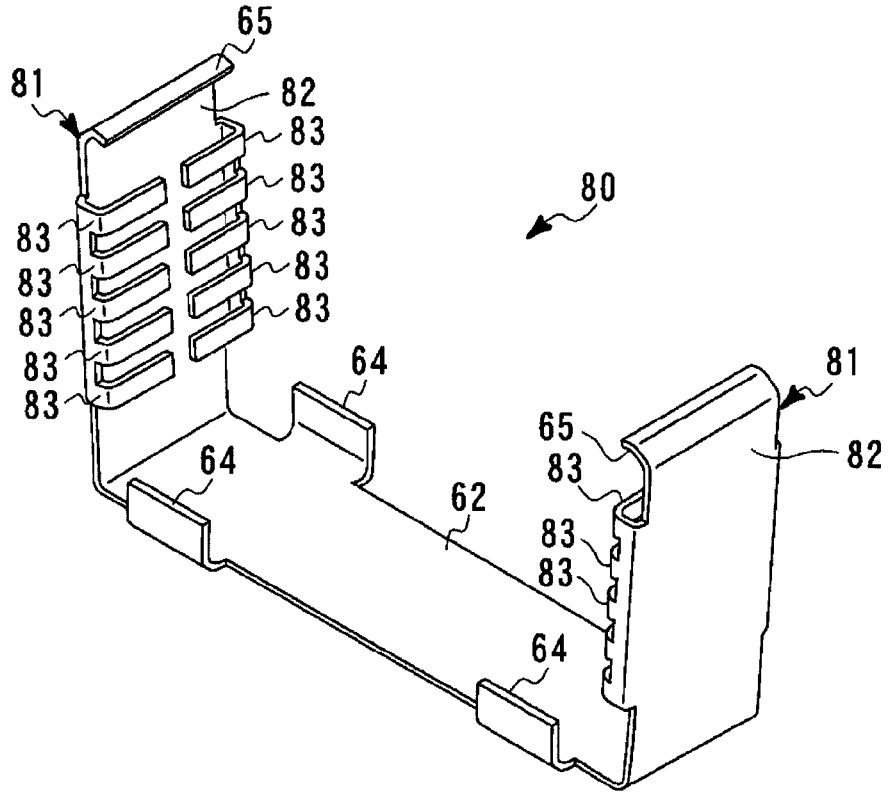
FIGS. 7A and 7B are a perspective view and a side elevation view of an arc shielding member of a fourth embodiment according to the present invention.
Figure 7B:
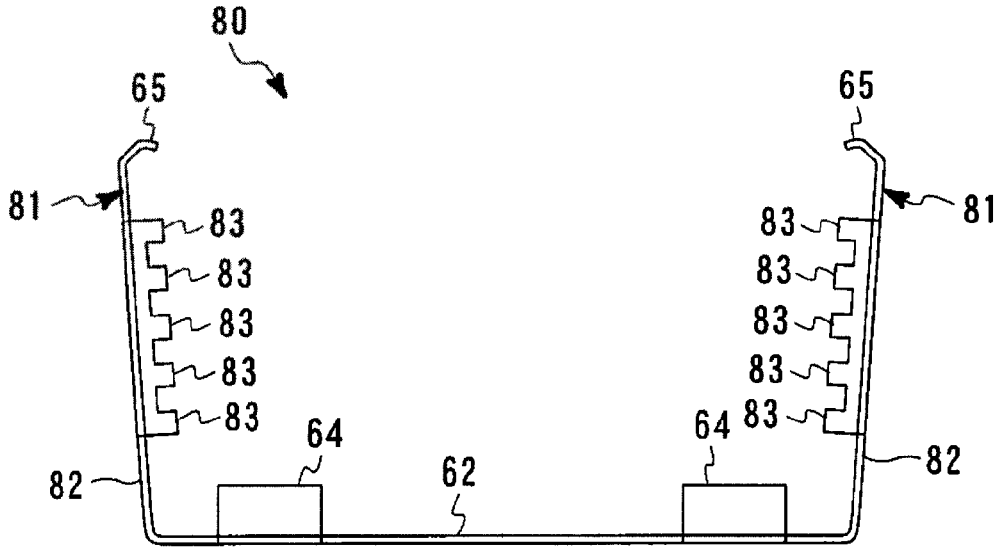

An arc shielding member 80 according to a fourth embodiment of the present invention is illustrated in FIGS. 7A and 7B.

Although the arms 63 of the arc shielding member 61 according to the first embodiment are provided with the side edge ribs 66, the configuration is not limited thereto. For example, like arms 81 of the arc shielding member 80 according to the fourth embodiment, there may be provided a plurality of flexing portions (arc receiving portions) 83 each of which is bent inward from both opposed side edges of a folded plate 82, and each of which extends along the inside surface of the folded plate 82. This configuration allows an increase in surface area of the arms 81 so that the arms can be easily hit by the arc, and certainly prevents the arc from passing to the back side. Because other portion are the same as those of the first embodiment, like portions are denoted by like reference signs and detailed description thereof is not given.

Fifth Embodiment

Figure 8A:
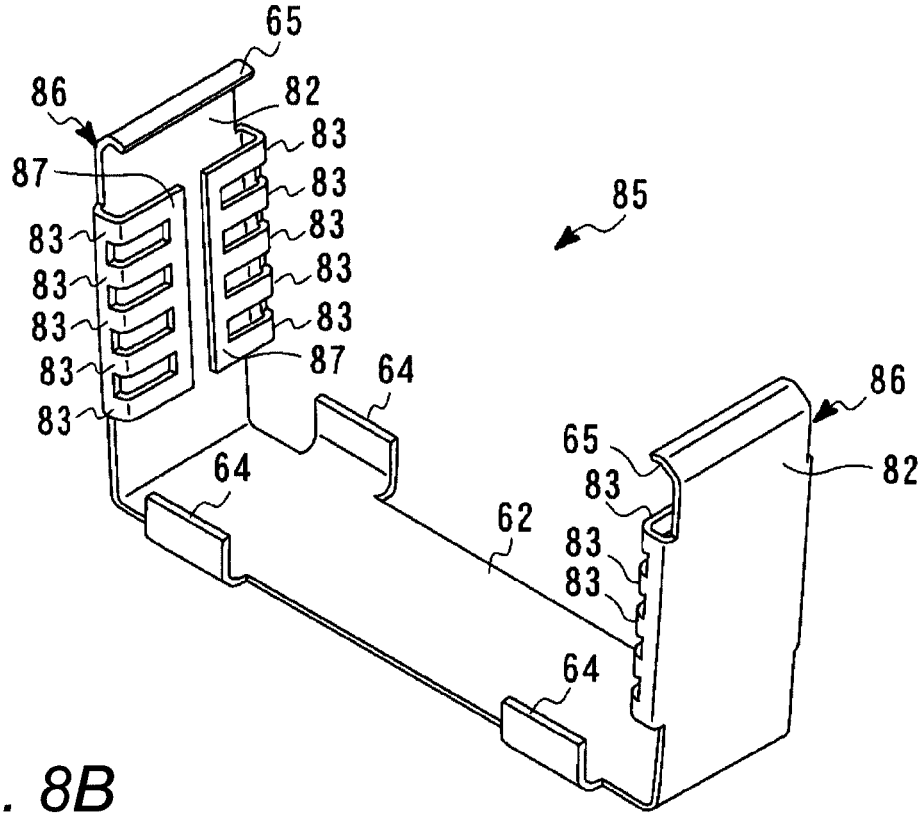
FIGS. 8A and 8B are a perspective view and a side elevation view of an arc shielding member of a fifth embodiment according to the present invention.
Figure 8B:
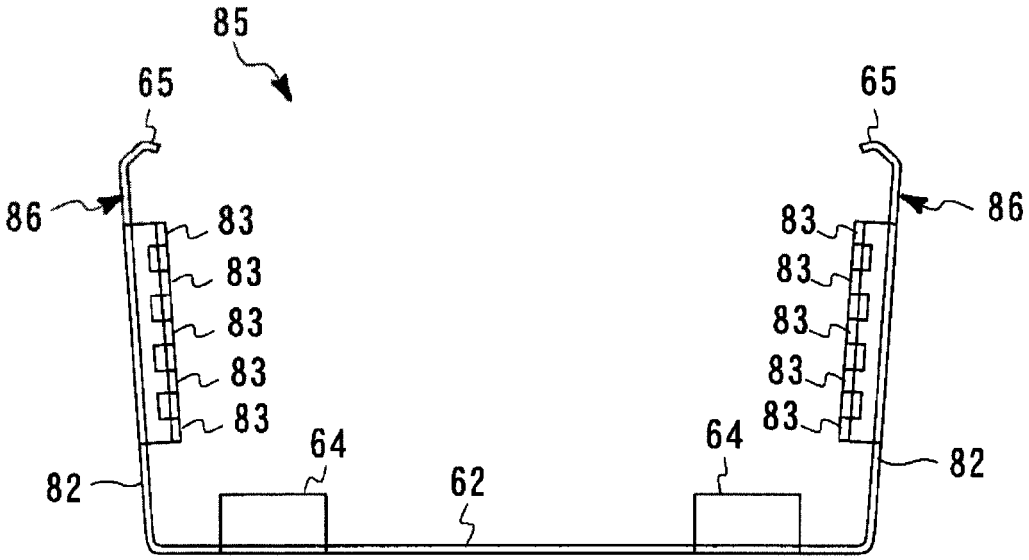

An arc shielding member 85 according to a fifth embodiment of the present invention is illustrated in FIGS. 8A and 8B.

Arms 86 of the arc shielding member 85 according to the fifth embodiment further include linear reinforcement pieces 87, which connect flexing portions 83 and 83 to each other, at end portions of the flexing portions 83 and 83 of the fourth embodiment, respectively. This configuration increases the strength of the flexing portions 83 and improves the bending accuracy. Because other portion are the same as those of the first embodiment, like portions are denoted by like reference signs and detailed description thereof is not given.

Sixth Embodiment

Figure 9A:
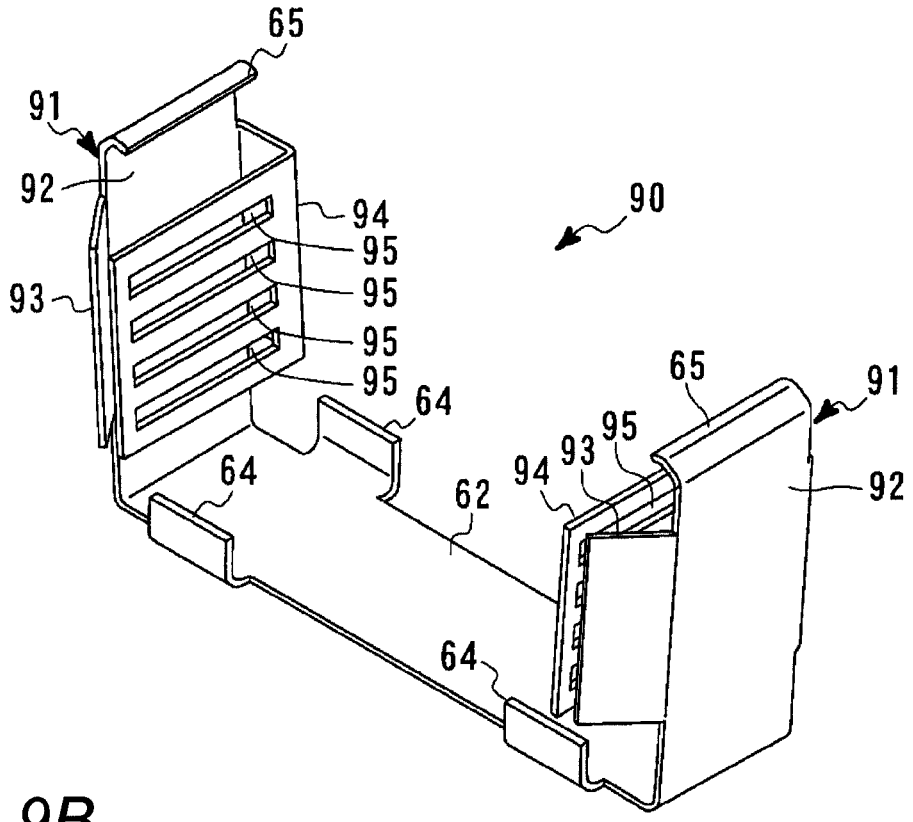
FIGS. 9A and 9B are a perspective view and a side elevation view of an arc shielding member of a sixth embodiment according to the present invention.
Figure 9B:
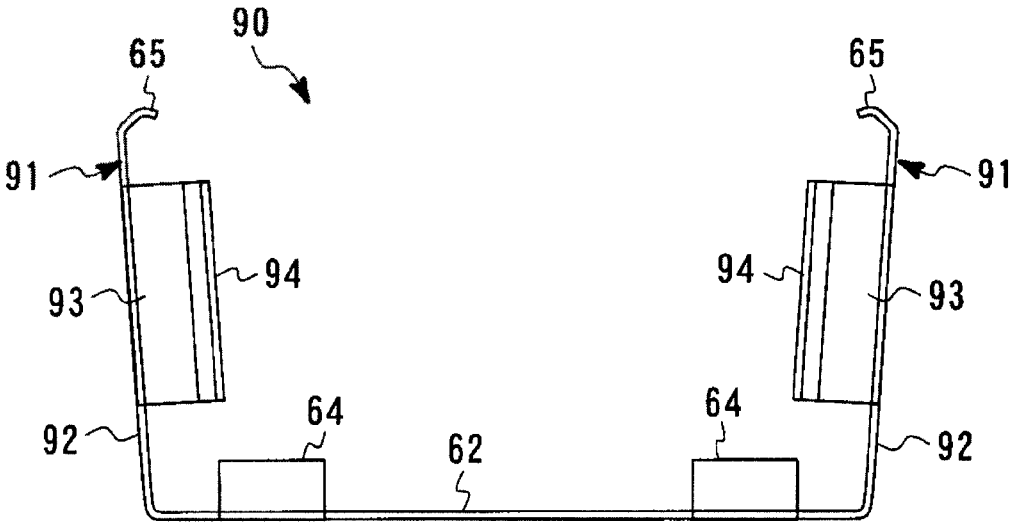

An arc shielding member 90 according to a sixth embodiment of the present invention is illustrated in FIGS. 9A and 9B.

Each arm 91 of an arc shielding member 90 according to the sixth embodiment is provided with a rectangular extension plate (arc receiving piece) 93 and a covering plate (arc receiving piece) 94. The extension plate 93 extends to broaden outward from one side edge of a folded plate 92. The covering plate 94 broadens outward from the other side edge of the folded plate 92, extends toward the extension plate 93, and extends along the folded plate 92. This configuration allows an increase in the width of the arms 91 so that the arc can be more certainly extinguished. The covering plate 94 is provided with a plurality of openings 95 so that the surface area may be increased. Because other portion are the same as those of the first embodiment, like portions are denoted by like reference signs and detailed description thereof is not given.

Seventh Embodiment

Figure 10A:
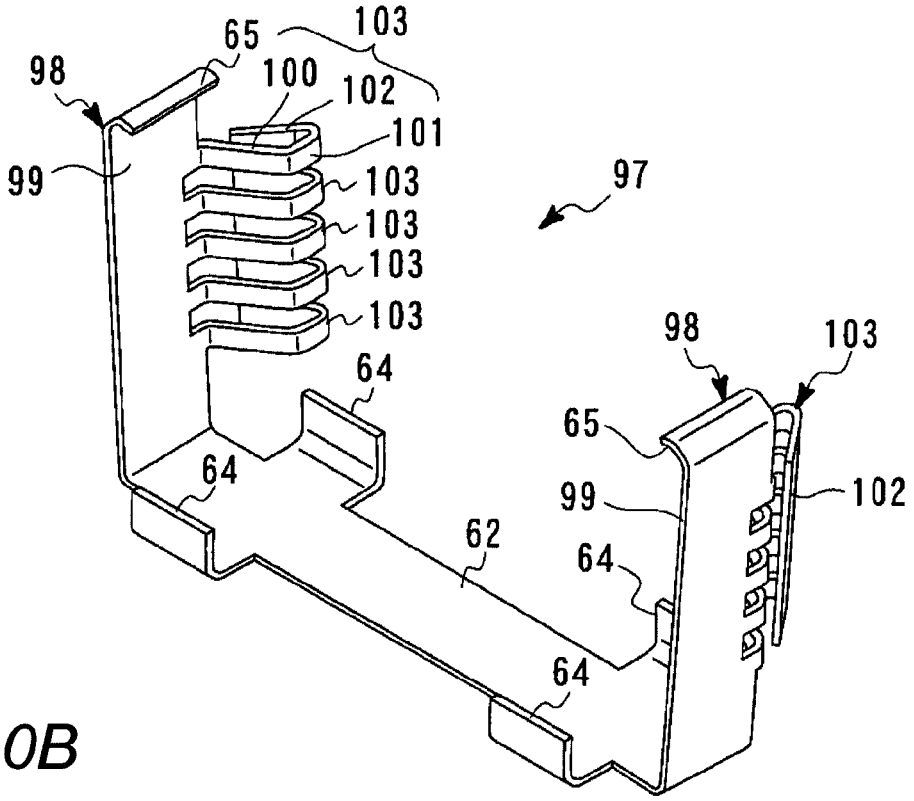
FIGS. 10A and 10B are a perspective view and a side elevation view of an arc shielding member of a seventh embodiment according to the present invention.
Figure 10B:
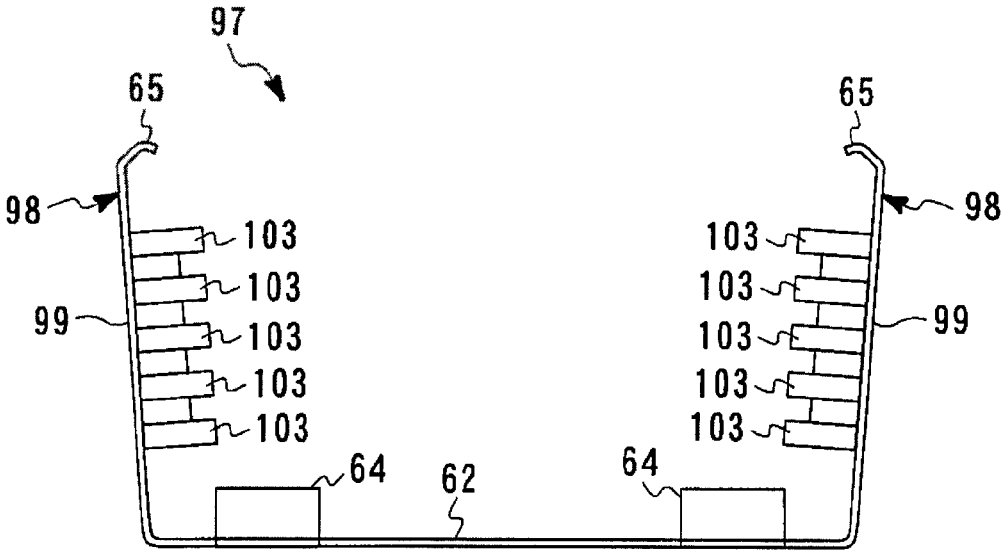

An arc shielding member 97 according to a seventh embodiment of the present invention is illustrated in FIGS. 10A and 10B.

Each arm 98 of the arc shielding member 97 according to the seventh embodiment is provided with an extension portion (arc receiving piece) 103 including a first narrow rib 100 which extends to broaden outward from one side edge of a folded plate 99, a second rib 101 which extends and bends outward from an end of the first rib 100, and a third rib 102 which bends to the back side from an end of the second rib 101 and extends toward the folded plate 99. Because the extension portion 103 is brought close to the fixed contact 33*a* and the movable contact 48*a*, an arc which spreads sideways can be easily trapped. Because other portion are the same as those of the first embodiment, like portions are denoted by like reference signs and detailed description thereof is not given.

Eighth Embodiment

Figure 11A:
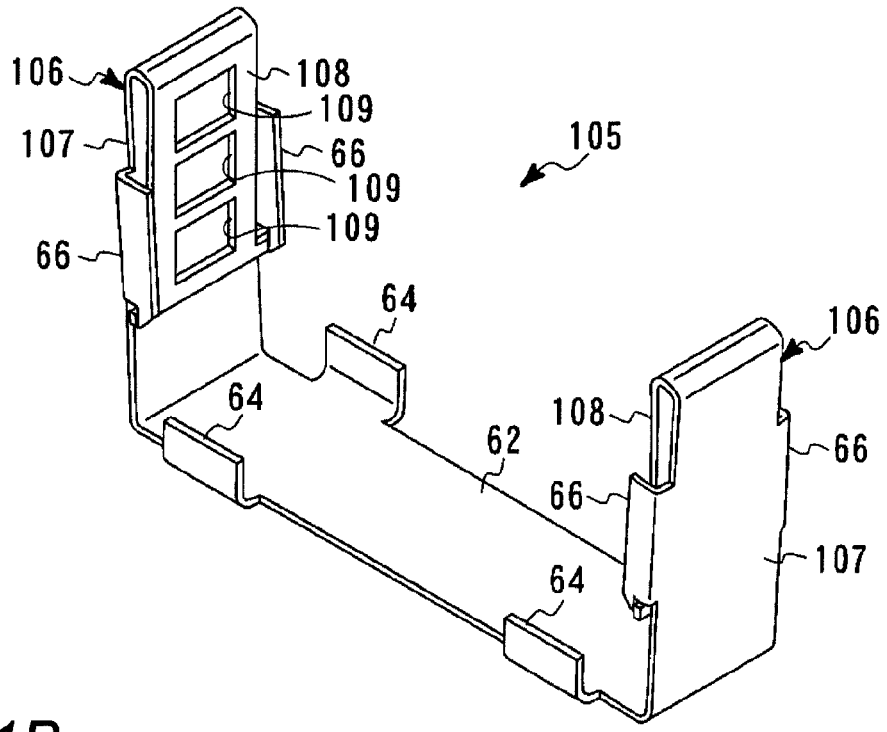
FIGS. 11A and 11B are a perspective view and a side elevation view of an arc shielding member of an eighth embodiment according to the present invention.
Figure 11B:
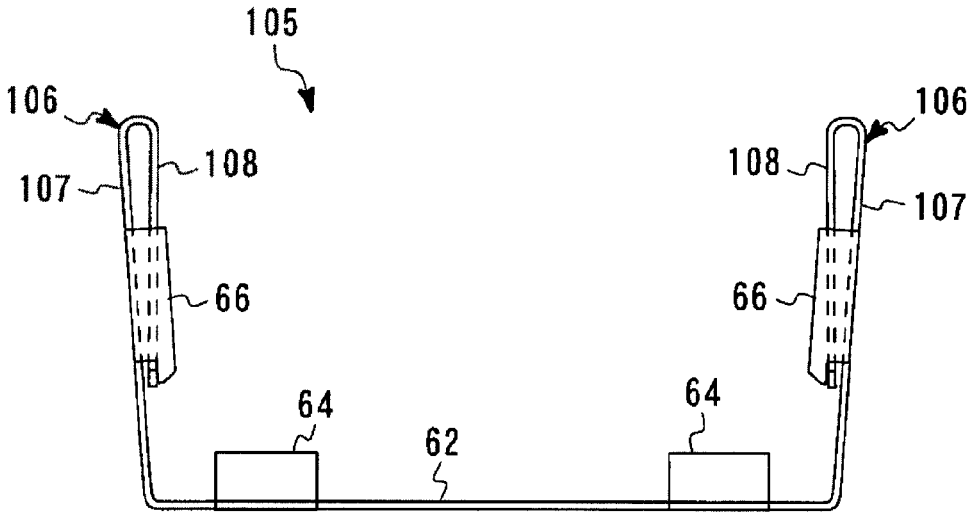

An arc shielding member 105 according to an eighth embodiment of the present invention is illustrated in FIGS. 11A and 11B.

As for an each arm 106 of the arc shielding member 105 according to the eighth embodiment, a plate-like covering plate 108 which extends from an upper end of a folded plate 107 is bent inward, and then bent downward to extend along the folded plate 107, and both side edge portions of a distal end thereof are latched to a lower end of a side edge rib 66. For this reason, an arc can be prevented from passing to the back side of the arm 106. In addition, the covering plate 108 is provided with a plurality of openings 109 so that the surface area may be increased. Because other portion are the same as those of the first embodiment, like portions are denoted by like reference signs and detailed description thereof is not given.

Example

Figure 12:
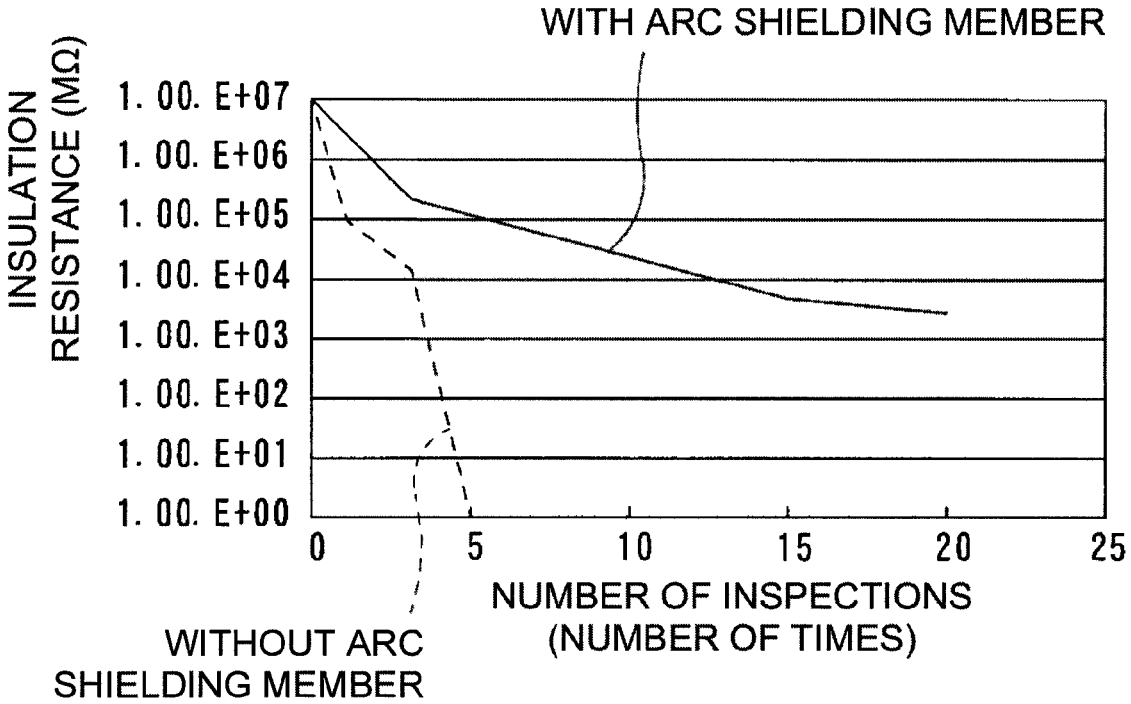
FIG. 12 is a graph which illustrates resistance of a sealed contact device according to the number of interceptions between contacts in a case where there is an arc shielding member and a case where there is no arc shielding member.

Inventors of the present application conducted experiments on durability of a sealed contact device which uses the arc shielding member 61 of the present invention. Specifically, an experiment was repeatedly performed which cancels (interrupts) the application of the voltage to the coil 51 in a state in which the current of 500 A is supplied between the fixed contacts 33*a* and 33*a* and the movable contacts 48*a* and 48*a* at a direct current voltage of 400V so that the fixed contacts 33*a* and 33*a* and the movable contacts 48*a* and 48*a* may separate from each other. At this time, as illustrated in FIG. 12, in the sealed contact device with the arc shielding member 61, as illustrated by a solid line, even though the experiment was repeated 20 times, it turned out that degradation of the fixed contact 33*a* and the movable contact 48*a* attributable to an arc was inhibited, and an abrupt decrease in an insulation resistance value of the sealed contact device was prevented. On the other hand, in the sealed contact device without the arc shielding member 61, as illustrated by a dotted line, when the experiment was repeated 5 times, it turned out that the fixed contact 33*a* and the movable contact 48*a* were degraded due to an arc which occurred, and the insulation resistance value of the sealed contact device abruptly decreased.

The inventors of the present application measured duration of the arc which occurred when the fixed contact 33*a* and the movable contact 48*a* are separated. As compared with the sealed contact device without the arc shielding member 61, the duration of the arc is shortened by 12.5% in the sealed contact device with the arc shielding member 61.

As for the sealed contact device according the present invention, it is needless to say that it may apply not only to the above-mentioned sealed electromagnetic relay but to other electromagnetic switches.

There has thus been shown and described a sealed contact device which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A sealed contact device comprising:

a housing;

two sets of contacts, each set of contacts comprising a fixed contact and a movable contact being disposed in the housing to face each other;

permanent magnets that attract an arc between each set of the fixed contacts and the movable contacts using a magnetic force, the permanent magnets disposed with the fixed contacts and the movable contacts interposed therebetween and the permanent magnets being spaced apart in a direction along a straight line connecting the two sets of contacts; and an arc shielding member disposed to attract the arc by current flowing between each set of the fixed contacts and the movable contacts and by the magnetic force, wherein the arc shielding member includes a plate-like connector and arms which are formed by perpendicularly bending both ends of the connector, respectively, and the arms of the arc shielding member are disposed at both sides of each set of the fixed contacts and the movable contacts in a direction perpendicular to the straight line connecting the two sets of contacts and disposed along opposed surfaces of the permanent magnets such that the arc hits one of the arms.

2. The sealed contact device according to claim 1, wherein the arc shielding member includes at least one arc receiving piece.

3. The sealed contact device according to claim 1, wherein the arc shielding member is placed between the movable contact and the fixed contact and the permanent magnets.

4. The sealed contact device according to claim 1, wherein the arc shielding member has a U shape cross section and is disposed in the housing.

5. The sealed contact device according to claim 4, wherein a base portion of the arc shielding member which has a U shape cross section is disposed on a bottom surface of the housing.

6. The sealed contact device according to claim 1, wherein the arc shielding member is made of metal.

7. The sealed contact device according to claim 2, wherein at least either the connector or the arms has at least one arc receiving piece.

8. The sealed contact device according to claim 7, wherein the at least one arc receiving piece is provided by bending an edge portion of the connector.

9. The sealed contact device according to claim 7, wherein the at least one arc receiving piece is provided by bending an edge portion of the arm, and a projection is formed on an inside surface of the arm.

* * * * *